US006052935A

United States Patent [19]

Howard

[11] Patent Number: 6,052,935

[45] Date of Patent: Apr. 25, 2000

[54] SHOTGUN CHOKE TUBE

[75] Inventor: Bradley Phillip Howard, Rineyville, Ky.

[73] Assignee: Remington Arms Company, Inc., Madison, N.C.

[21] Appl. No.: 09/114,000

[22] Filed: Jul. 10, 1998

[51] Int. Cl.[7] ..... F41A 21/40

[52] U.S. Cl. ..... 42/79; 42/75.02

[58] Field of Search ..... 42/79, 75.01; 89/14.6

[56] References Cited

U.S. PATENT DOCUMENTS

| | | | |
|---|---|---|---|
| 487,487 | 12/1892 | Mason | 42/75.02 |
| 529,455 | 11/1894 | Marlin | 42/75.02 |
| 577,281 | 2/1897 | Browning | 42/75.02 |
| 688,227 | 12/1901 | Cory | 42/79 |
| 985,308 | 2/1911 | Voorhis | 42/79 |
| 1,455,661 | 5/1923 | Rhinehart | 42/79 |
| 1,679,048 | 7/1928 | Miller | 42/79 |
| 2,428,232 | 9/1947 | Limon | 42/79 |
| 2,656,637 | 10/1953 | Richards | 42/79 |
| 2,736,118 | 2/1956 | Clarkson et al. | 42/75.02 |
| 2,894,348 | 7/1959 | Cutts | 42/79 |
| 3,161,979 | 12/1964 | Lowe | 42/79 |
| 3,243,910 | 4/1966 | Weiser | 42/79 |
| 3,698,747 | 10/1972 | Wing | 285/305 |
| 4,467,546 | 8/1984 | Beretta | 42/79 |
| 4,546,564 | 10/1985 | A'costa | 42/76 |
| 5,317,825 | 6/1994 | Vatterott et al. | 42/79 |
| 5,452,535 | 9/1995 | See et al. | 42/79 |
| 5,479,736 | 1/1996 | Forrester | 42/72 |
| 5,592,770 | 1/1997 | Gudgel | 42/105 |

*Primary Examiner*—Charles T. Jordan
*Assistant Examiner*—Denise J. Buckley
*Attorney, Agent, or Firm*—Rhodes & Mason, P.L.L.C.

[57] ABSTRACT

The present invention relates to a shotgun choke tube including a cylindrical body having an interrupted thread section located on its outside surface. A continuous thread section made up of at least one continuous full thread circumscribing the cylindrical body outside surface is provided adjacent the interrupted thread section. The continuous thread section may comprise between about two and about five continuous threads. The choke tube interrupted threads engage corresponding interrupted threads located on the interior surface of a shotgun barrel muzzle internal surface. The choke tube may be secured in a shotgun barrel with only a fraction of the turns required to secure well-known choke tubes having a long section of continuous threads.

28 Claims, 5 Drawing Sheets

SHOTGUN CHOKE TUBE

FIELD OF THE INVENTION

The present invention relates to devices that regulate and constrict the spread of shot leaving the muzzle of a shotgun. More particularly, the present invention relates to a shotgun choke tube that is easy to install and remove from the muzzle of a shotgun barrel.

BACKGROUND OF THE INVENTION

A choke is a small constriction located near the muzzle of a shotgun barrel that changes the patterning characteristics of a shot charge. Chokes have been used in firearms, and in particular shotguns, for many years to impact the percentage of pellets that will hit a target at a fixed distance from the muzzle. While some gun barrels have fixed chokes, removable choke tubes are preferred by many users.

Removable chokes permit one shotgun to be used for a variety of shooting applications. For example, very tight, i.e., small exit diameter, chokes are used to maintain a high percentage of the shot charge in a tight pattern at a long distance from the muzzle of the shotgun. This characteristic is desirable for long-range shooting situations encountered when hunting waterfowl. This degree of choke may also be desirable for some forms of trap shooting. At the other end of the spectrum, a very wide shot dispersion is desirable for short-range shooting situations such as skeet shooting.

The versatility provided by removable chokes does not come without certain tradeoffs. Modern choke tubes are threaded inserts, which are secured in shotgun barrel muzzles by using approximately 0.5 inches of very fine, continuous threads. The selection of this thread style is necessitated by the limited wall thickness available for this threaded connection, and the need for a secure installation. A certain amount of thread engagement is required to help ensure that the choke tube will not loosen extensively or be expelled from the barrel during firing. To this end, the choke tube is provided with continuous threads on its exterior surface. The barrel has a corresponding set of continuous threads located on its inner surface. Given this design configuration, a choke tube can require upwards of 20 revolutions to insert or extract. This process can be time-consuming and annoying for users.

Thus there is a need for a removable choke tube threaded insert that a user can more easily insert and extract using fewer revolutions, but that does not experience excessive loosening or expulsion during use.

SUMMARY OF THE INVENTION

The present invention relates to a choke tube for a shotgun having a barrel including a cylindrical body with an interrupted thread section located on the outside surface of the cylindrical body. In one embodiment, a continuous thread section is provided adjacent the interrupted thread section. The continuous thread section comprises at least one continuous full thread circumscribing the cylindrical body outside surface. In a preferred embodiment, between about two (2) to about five (5) continuous threads are provided in the continuous thread section. The juxtaposition of the interrupted and continuous thread sections forms at least one thread finger around the circumference of the choke. In a preferred embodiment, 3 thread fingers are provided, but a lesser number of fingers are also possible.

The choke may further include an indicator on its outside surface to facilitate alignment of the interrupted thread section with a corresponding interrupted thread section in a shotgun adapted to receive the choke.

The present invention also relates to a shotgun adapted to cooperate with the choke. The shotgun includes a barrel with a muzzle end. A choke tube is mounted in the muzzle end of the barrel, the choke tube comprising a cylindrical body including an interrupted thread section located on the outside surface of the cylindrical body. A continuous thread section adjacent the interrupted thread section is also provided in one embodiment. The continuous thread section comprises at least one continuous thread circumscribing the cylindrical body outside surface. The shotgun barrel further includes a section of interrupted threads located on the barrel muzzle end interior surface wherein the barrel threads are positioned to engage the choke tube threaded sections in locking engagement with five (5) or less turns of the choke tube. The juxtaposition of the interrupted thread section and the continuous thread section form at least one thread finger around the circumference of the choke outside surface. An alignment indicator is provided on the choke outside surface and is positioned thereon in longitudinal alignment with one of the thread fingers. This alignment between the two enables the choke to be inserted into the shotgun barrel so that the interrupted thread sections of the choke and barrel will engage each other properly.

These and other aspects of the present invention will become apparent to those skilled in the art after a reading of the following description of the preferred embodiments when considered in conjunction with the drawings. It should be understood that both the foregoing general description and the following detailed description are exemplary and explanatory only and are not restrictive of the invention as claimed.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION OF THE PREFERRED EMBODIMENT

Figure 2:
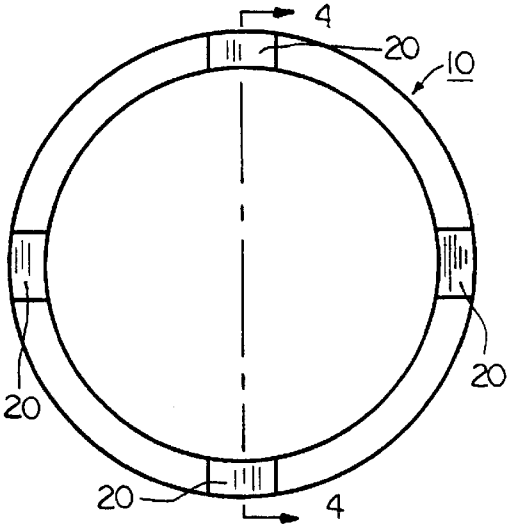
FIG. 2 is an end elevation view taken at the right end of the choke tube depicted in FIG. 1.

As illustrated in FIGS. 1–4, a choke tube 10 in accordance with a preferred embodiment of the present invention includes a hollow cylindrical body 12 whose outside surface includes an interrupted thread section 14 and a continuous thread section 16. In a preferred embodiment, the continuous thread section 16 is adjacent the interrupted thread section 14. Interrupted thread section 14 includes a plurality of threaded portions 18 defining coves 19 there between.

Figure 1:
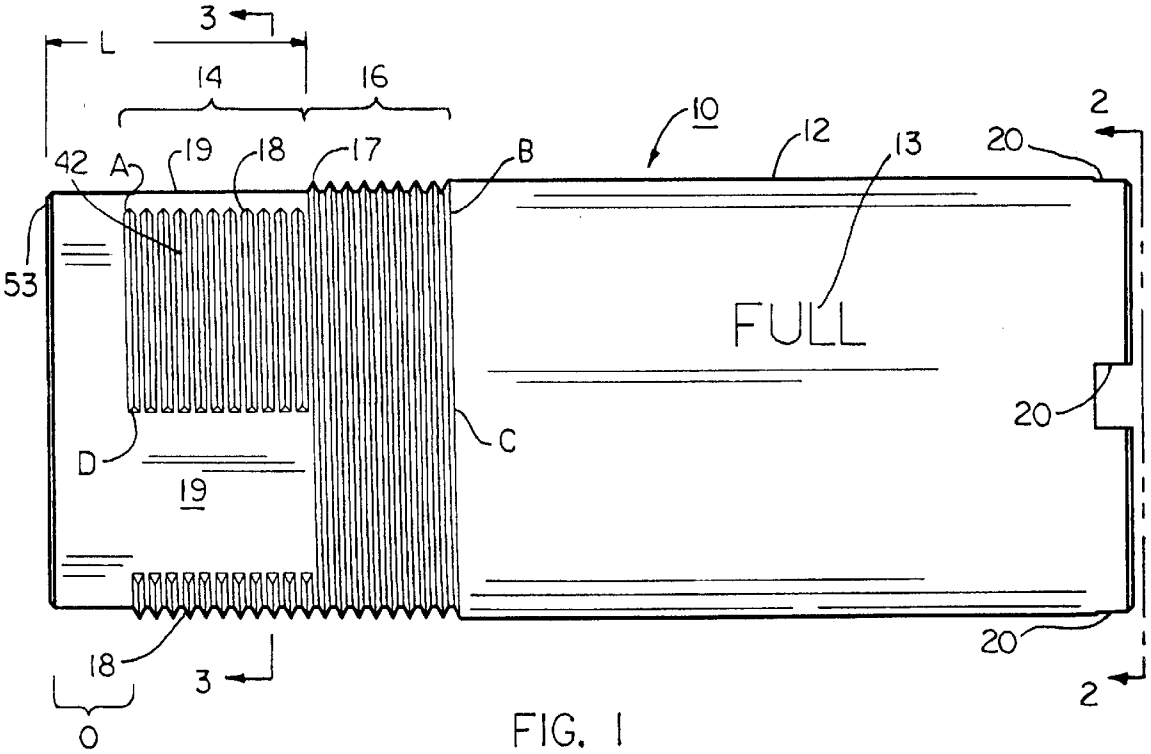
FIG. 1 is a side elevation view of the choke tube of the present invention showing the continuous and interrupted threads at one end of the tube.

Continuous thread section 16 comprises at least one continuous full thread 17 circumscribing the cylindrical body outside surface, although a preferred embodiment shown in FIG. 1 is depicted with several continuous threads. At least one continuous thread, or the first of a plurality of continuous threads, preferably must be a full thread. This term is understood in the art to mean a thread that is a full height thread around the entire circumference of the cylindrical body outside surface. In one embodiment, the choke tube of the present invention may be provided with between about two (2) and about five (5) continuous threads. In another preferred embodiment, the threaded section comprises between about three (3) and about four (4) continuous threads.

Figure 6:
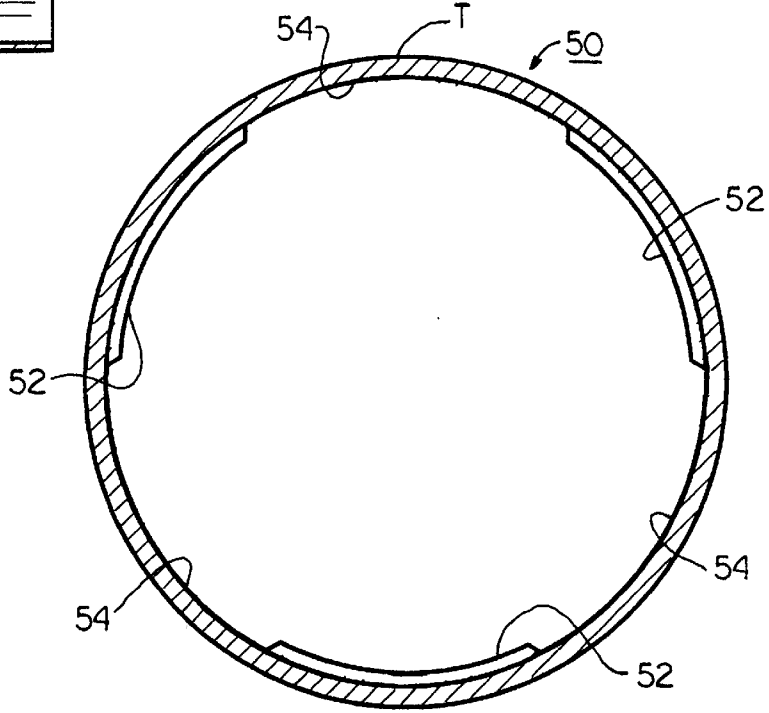
FIG. 6 is a sectional view taken through the barrel muzzle along 6—6 of FIG. 5, rotated so that the channel between the thread sections is positioned at the top of the barrel.

The choke tube may further include other features to include an indicator 13 ("FULL") of the amount of constriction provided by a particular choke tube. This indicator could include such terms as "FULL," "MODIFIED," or "SKEET," as well as others, as is well known in the art. Other types of indicators such as a geometric alignment aide may be used. The indicator 13 may serve to ensure a proper alignment of choke tube 10 as it is inserted into a shotgun. If indicator 13 is in longitudinal alignment with thread finger 42, and if barrel channel 54 is provided at the top of barrel 50 (FIG. 6), then proper alignment for insertion will be ensured by aligning indicator 13 with the top of the gun barrel prior to inserting choke tube 10 into barrel 50. (The "top of the barrel" phrase means the 12:00 position, T, as shown in FIG. 6.) Choke tube 10 may also include a provision for engagement with a tool 21, shown generally in FIG. 8, for tightening the choke tube firmly after having been seated by hand. In a preferred embodiment, this provision for engagement with a tightening tool is comprised of at least two notches 20 that are recessed into the end of choke tube 10. Preferably, notches 20 are located at a second end of cylindrical body 12, opposite threaded sections 14, 16. In a preferred embodiment depicted in FIGS. 1 and 2, four notches are provided.

Figure 4:
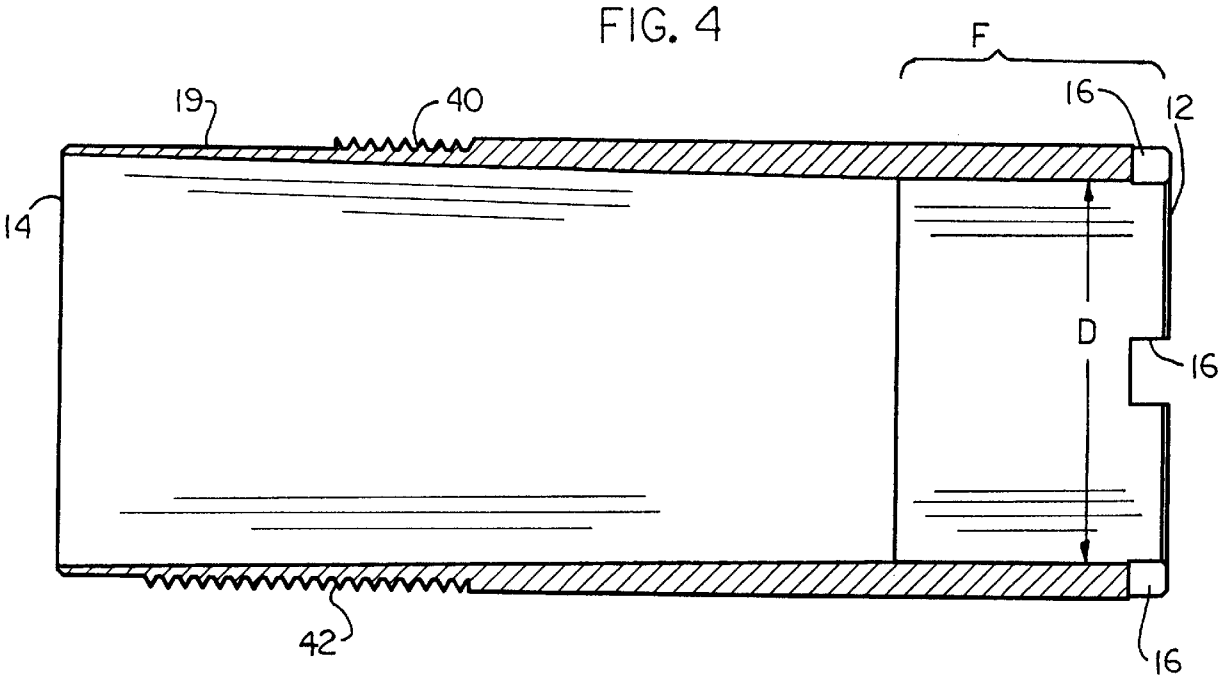
FIG. 4 is a longitudinal sectional view taken along 4—4 in FIG. 2.
Figure 3:
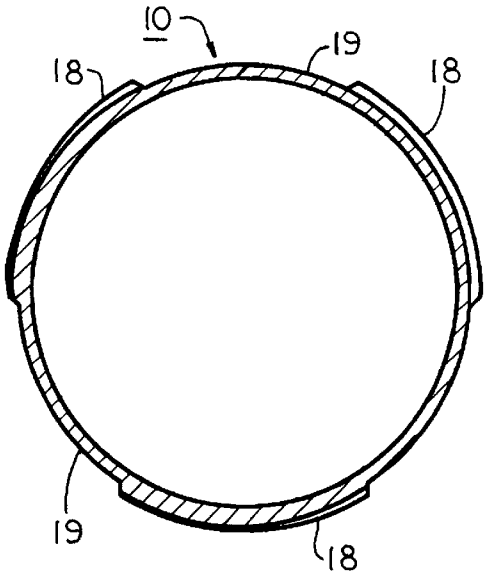
FIG. 3 is a sectional view taken along 3—3 through the interrupted thread section of the choke tube of the present invention as depicted in FIG. 1.

The juxtaposition of interrupted thread section 14 and continuous thread section 16 creates a series of thread fingers 42 as depicted in FIGS. 1 and 4. A "thread finger" as used herein refers to the region defined by points A, B, C, and D in FIG. 1. The thread finger 42 is shown in sectional view in FIG. 4. The plurality of spaced apart thread fingers, separated by cove(s) 19, are positioned around the circumference of cylindrical body 12. It is believed that the present invention will function properly with less than three thread fingers. In a preferred embodiment, three thread fingers are provided. The practice of the present invention includes providing other numbers of thread fingers as well.

Figure 5:
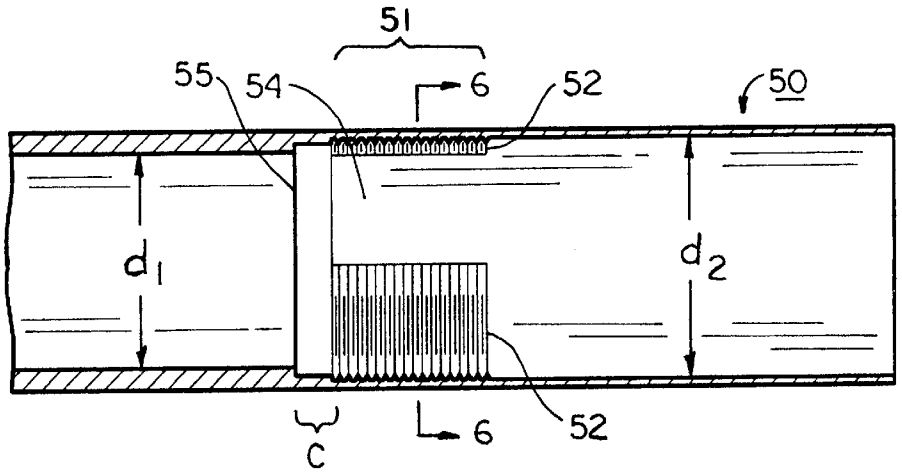
FIG. 5 is a partial sectional view of a gun barrel taken at the muzzle end of the barrel depicting the interrupted threads provided on the interior surface of the barrel for holding the choke tube for the present invention.

The choke tube 10 of the present invention can be secured in a shotgun barrel, which is depicted in FIGS. 5 and 6. The interior surface of the barrel muzzle end is provided with a section of interrupted threads around its interior circumference. This section is made up of barrel thread portions 52 that define barrel channels 54 therebetween. In the preferred embodiment depicted in FIG. 6, three thread portions 52 and three channels 54 are formed. The precise radial locations of the thread portions and channels 54 may vary in orientation around the interior circumference of the barrel. It can been seen in FIG. 5 that the shotgun barrel diameter d1 before the interrupted threads is less than the barrel diameter d2 after the interrupted threads. The desired constriction within the barrel is achieved by using a choke tube, having a reduced diameter D within the flat region F inside the choke tube 10 (see FIG. 4).

Figure 9:
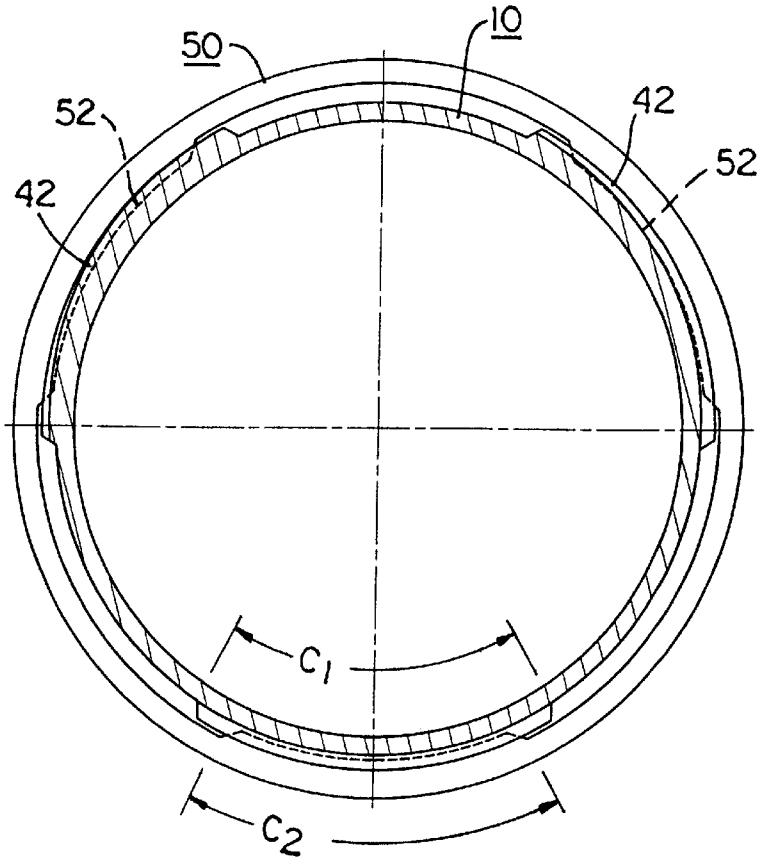
FIG. 9 is a cross-sectional view depicting a choke tube engaged in tightened position within a barrel.

Choke tube 10 is installed in barrel 50 by first aligning thread fingers 42 with barrel channels 54 (see FIG. 7), inserting the tube 10 within the barrel 50 and turning the choke tube until thread engagement secures the tube 10 in barrel 50 (see FIG. 9). The choke tube may be tightened further by using a well-known tightening tool 21 that engages recessed notches 20.

Figure 8:
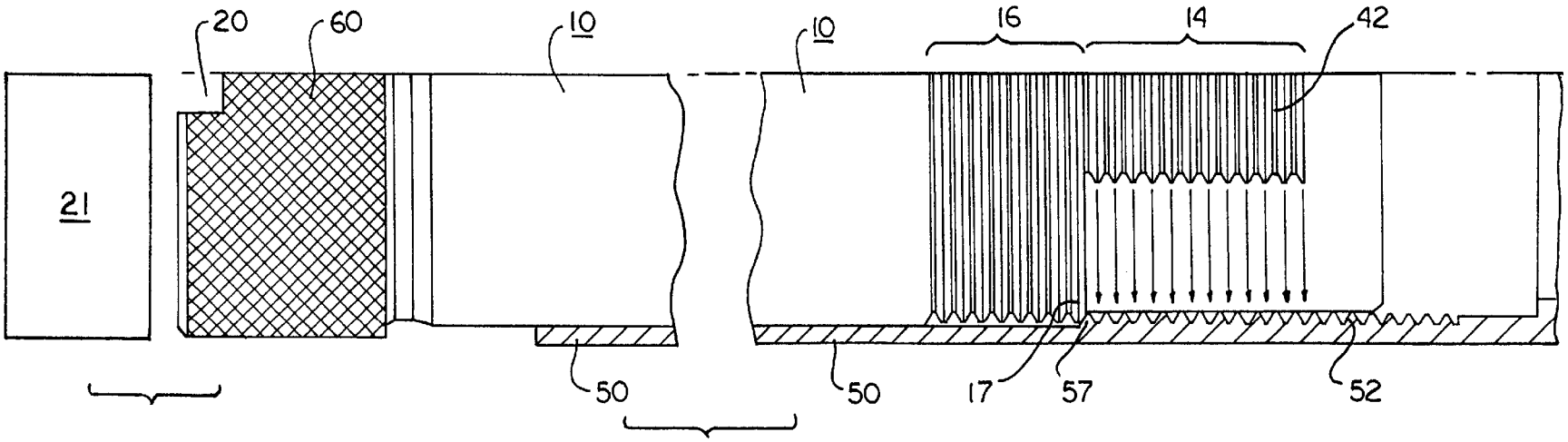
FIG. 8 is a partial cross-section view of a choke inserted into a barrel prior to threading.

In yet another preferred embodiment, installation of the choke tube 10 may be facilitated through the use of a raised knurled exterior surface 60 on one end of the choke tube, as shown in FIG. 8. The use of such knurled surfaces to facilitate hand tightening is well known in the art. In practice, the user could install the choke tube by hand, grasping and turning the knurled section of the choke tube. Recessed notches 20, in addition to the knurled section, could also be used to assist in further tightening of the choke tube as with tool 21.

The number of turns required to tighten choke tube 10 securely inside barrel 50 depends on the number of continuous threads provided on choke tube 10. A preferred embodiment of the present invention will require only a small fraction of the number of turns as compared to the number of turns required to secure known choke tubes having continuous threads only.

In a preferred embodiment, once the choke tube 10 is installed in the barrel 50, at or about 100% of the barrel threads 52 engage the choke tube threads 18, 42. Thus, choke tube threads 42 will come to rest engaged with the barrel threads 52, as shown in FIG. 9. Preferably, the thread portions 42 should not be within the channel portions 54 when the choke tube 10 is fully tightened. Preferably, the coves 19 of the choke tube should be in radial alignment to the channels 54, when the choke tube is fully tightened. However, effective securement of the choke tube 10 within barrel 50 will occur with less than full engagement. Variances in machining technology can allow for some misalignment between 42 and 52, but at least 90% engagement is preferred.

Figure 7:
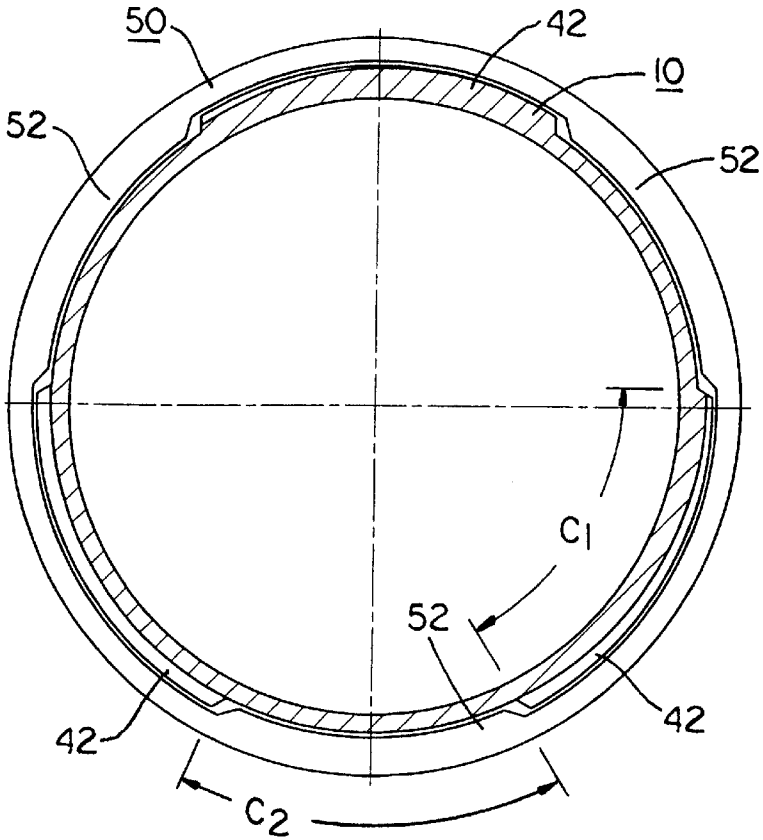
FIG. 7 is a cross-sectional view depicting a choke tube during insertion within a barrel.

FIG. 7 shows a cross-section view of a barrel 50 with a choke tube 10 shown at insertion. In use, the choke tube 10 is rotated prior to insertion to the correct position so that choke tube threads 42 pass by the interrupted barrel threads 52. (Proper rotation can be facilitated through the use of an alignment indicator 13 as discussed above.)

FIG. 8 shows a partial cross-section view of a choke tube 10 at the point at which the choke tube is inserted far enough into the barrel 50 to commence thread engagement and tightening. In a preferred embodiment, the first barrel thread 57, and the first continuous choke tube thread 17, are both full threads. In other words, the threads are a complete tooth. This will help ensure that the barrel interrupted threads from section 14 align correctly when they engage barrel threads 52, as shown by the arrows of FIG. 8.

Also shown in FIG. 8 is a knurled turning section 60, along with recessed notches 20.

FIG. 9 depicts a cross-section view of a barrel 50 with a choke tube 10 in an engaged position. The choke tube threads 42 engage threads 52. As shown in both FIGS. 7 and 9, the circumference $C_1$ of the choke tube interrupted threads 42 can be greater than the circumference $C_2$ of the barrel threads 52. This allows for some degree of overlap of the thread surfaces, and helps to ensure that near 100% of the barrel threads are engaged with some portion of the choke tube threads.

Proper alignment to achieve near 100% engagement of threads 42 with threads 52 when the choke tube is fully tightened can be achieved in several ways. In one embodiment, the threads 42 of the choke tube are qualified such that the beginning thread always starts at the same position radially on the choke tube and always starts at the same distance 0 offset (see FIG. 1) from the choke tube end 53. Controlling these positions, as well as the counterbore distance C (see FIG. 5), will allow the choke tube to fully tighten when choke tube end 53 abuts barrel counterbore 55, while the threads 42 are fully engaged with threads 54. In a preferred embodiment, offset distance O is 0.155 inches, while counterbore distance C is 0.125 inches, and choke tube thread begins at 60 degrees from the 12:00 position.

In order to assure proper alignment during manufacture, an indexing gauge (not shown) can be used to test counterbore distance C. The radial position of the starting thread of the choke tube, as well as the offset distance O can be controlled in the machining operation of the choke tube. An indexing gauge can be used to assure that the counterbore distance C is correct. Such a gauge can measure the counterbore distance C, and then the depth can be increased if necessary by reaming. Tests have shown that as much as 0.005 inches of counterbore distance can result in a 60-degree radial turn. A choke tube that becomes tightened with an inaccurate counterbore distance could mean that the interrupted thread section 14 of the choke tube could fall within the barrel channels 54. This condition is not preferred.

While one method of assuring near 100% thread engagement is discussed, other methods and variations may be utilized without departing from the scope of this invention, as those skilled in the art will readily understand.

In another preferred embodiment, the threads of the present invention are machined in such a way to ensure that misalignment is avoided during insertion. Such thread qualification is well known in the art, and helps minimize misalignment problems. Misalignment can cause the threads to become galled or seized, thereby adversely impacting operation and performance of the choke tube. Hence, the threads of the choke tube and mating threads of the barrel are matched to ensure alignment of the beginning portion of the mating threads. The matching results by proper machining of the threads and the proper insertion by the user of the tube into the barrel in accordance with the alignment indicator markings discussed above.

The choke tube of the present invention provides several advantages over known choke tubes. First, choke tube 10 provides secure, continuous thread-type engagement in a shotgun barrel with a small number of turns of the tube. The present invention also provides an inherent or built-in indicator if the choke tube has loosened. As the choke tube begins to loosen, the continuous thread portion holds the choke tube in place until the loose condition is detected and corrected. Since most users change or check their choke tube somewhat frequently, a loose condition can be found and corrected. Consequently, the choke tube of the present invention does not require any ancillary apparatus to hold the tube securely in the shotgun barrel.

The use of one-piece choke tubes allows users the versatility of carrying or owning several choke tubes, and easily replacing one with another. The absence of multiple or interlocking parts in a choke tube lends simplicity, ease of construction and ease of use to its design. Moreover, the use of a threaded insert, as opposed to a threaded tube that fits on the outside of a gun barrel, has several advantages. Exterior choke tubes can interfere with the sight block located atop the barrel. Moreover, exterior threads on a barrel can become worn or dirty, interfering with proper choke tube installation. Other benefits exist as well, as can be readily grasped by those skilled in the art.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims and their equivalents.

What I claim is:

1. A one-piece choke tube for a shotgun comprising:

a) a cylindrical body including an interrupted thread section located on the outside surface of the cylindrical body; and b) a continuous thread section adjacent the interrupted thread section wherein the continuous thread section comprises at least one continuous full thread circumscribing the cylindrical body outside surface and wherein the one-piece choke tube threads autonomously holds the choke tube securely in the shotgun.

2. The choke tube of claim 1 wherein the continuous thread section comprises between about 2 and about 5 continuous threads.

3. The choke tube of claim 1 wherein the threaded section comprises between about 3 and about 4 continuous threads.

4. The choke tube of claim 1 wherein the interrupted and continuous thread sections are positioned at a first end of the choke tube and the choke tube further includes a section for engaging a tightening tool, the section for engaging located at an opposite second end of the choke tube.

5. The choke tube of claim 4 wherein the section for engaging includes at least one recessed notch for receiving a tightening tool.

6. The choke tube of claim 4 wherein the section for engaging includes four recessed notches for receiving a tightening tool.

7. The choke tube of claim 1 wherein the interrupted and continuous thread sections combine to form at least one thread finger on the outside surface of the choke tube.

8. The choke tube of claim 7 further including an alignment indicator located on the outside surface of the cylindrical body and positioned in longitudinal alignment with one of the at least one thread finger.

9. The choke tube of claim 7 where the interrupted and continuous thread sections combine to form three thread fingers on the outside surface of the choke tube.

10. A one-piece choke tube for a shotgun having a barrel comprising:

a) a cylindrical body including an interrupted thread section located on the outside surface of the cylindrical body; and a continuous thread section adjacent the interrupted thread section wherein the continuous thread section comprises between about 2 and about 5 continuous threads circumscribing the cylindrical body outside surface, wherein the interrupted and continuous thread sections combine to form at least one thread finger positioned around the circumference of the cylindrical body wherein the choke tube threads autonomously holds the choke tube securely within the shotgun barrel.

11. A shotgun barrel, having a muzzle end with an interior surface, the shotgun barrel comprising:

a) a one-piece choke tube mounted in the muzzle end of the barrel, the choke tube comprising i) a cylindrical body including an interrupted thread section located on the outside surface of the cylindrical body; and ii) a continuous thread section adjacent the interrupted thread section wherein the continuous thread section comprises at least one continuous thread circumscribing the cylindrical body outside surface; and b) a section of barrel interrupted threads located on the interior surface of the barrel muzzle end wherein the barrel threads are positioned to engage the choke tube threaded sections in locking engagement autonomously securing apparatus to hold the choke tube securely within the barrel.

12. The shotgun barrel of claim 11 wherein the choke tube continuous thread section comprises between about 2 and about 5 continuous threads.

13. The shotgun barrel of claim 11 wherein the choke tube continuous thread section comprises between about 3 and about 4 continuous threads.

14. The shotgun barrel of claim 11 wherein the interrupted and continuous thread sections combine to form at least one thread finger on the outside surface of the choke tube.

15. The shotgun barrel of claim 11 wherein the choke interrupted and continuous thread sections are positioned at a first end of the choke tube and the choke tube further includes a section for engaging a tightening tool, the section for engaging located at an opposite second end of the choke tube.

16. The shotgun barrel of claim 15 wherein the section for engaging includes at least one recessed notch for receiving a tightening tool.

17. The shotgun barrel of claim 15 wherein the section for engaging includes four recessed notches for receiving a tightening tool.

18. The shotgun barrel of claim 11 further including an alignment indicator located on the outside surface of the cylindrical body and positioned in longitudinal alignment with one of the at least one thread finger.

19. A one-piece choke tube for a shotgun having a barrel comprising:

a) a cylindrical body including an interrupted thread section located on the outside surface of the cylindrical body and positioned at a first end of the choke tube;

b) a continuous thread section adjacent the interrupted thread section wherein the continuous thread section comprises between about 2 to 5 continuous threads circumscribing the cylindrical body outside surface;

c) a tightening tool engaging section located at an opposite end of the choke tube comprising at least two recessed notches for receiving a tightening tool wherein the juxtaposition of the interrupted and continuous thread sections form at least one spaced apart thread finger positioned around the circumference of the cylindrical body thereby holding the choke tube autonomously within the shotgun.

20. A method of securing a choke tube to a barrel of a shotgun comprising:

a) providing a one-piece choke tube;

b) installing the one-piece choke tube in the barrel by rotating the choke tube less that 5 revolutions, whereby the step of installing the one-piece choke tube also accomplishes the step of securing the one-piece choke tube on the barrel in such a manner that the one-piece choke tube does not loosen in an unacceptable manner after repeated shotgun discharges wherein the choke tube threads autonomously holds the choke tube securely within the barrel.

21. The method of claim 20 whereby the choke tube is a threaded insert choke tube and the barrel has an interior surface with a set of threads that mate with the choke tube threads.

22. The method of claim 21 whereby the step of installing and securing the choke tube is accomplished by using a combination of interrupted threads and uninterrupted threads on both the threaded insert choke tube and interrupted threads on the interior of the barrel.

23. The choke tube of claim 1 wherein the interrupted and continuous thread sections are positioned at a first end of the choke tube and the choke tube further includes a plurality of recessed notches located at an opposite second end of the choke tube.

24. The choke tube of claim 23 wherein the recessed notches receive a tightening tool.

25. The choke tube of claim 23 wherein the second end has four recessed notches.

26. The choke tube of claim 11 wherein the choke interrupted and continuous thread sections are positioned at a first end of the choke tube and the choke tube further includes a plurality of recessed notches located at an opposite second end of the choke tube.

27. The choke tube of claim 26 wherein the recessed notches receive a tightening tool.

28. The choke tube of claim 26 wherein the second end has four recessed notches.

* * * * *